US010323466B2

(12) United States Patent
Price et al.

(10) Patent No.: US 10,323,466 B2
(45) Date of Patent: Jun. 18, 2019

(54) DRILLING RIG AND METHOD OF USE

(71) Applicant: PIONEER ENERGY SERVICES CORP., San Antonio, TX (US)

(72) Inventors: Christopher Price, San Antonio, TX (US); D. Jarrett Tarrent, The Woodlands, TX (US); David Armbruster, Spring, TX (US); Wilson Orr, Humble, TX (US); Marc Moore, Houston, TX (US)

(73) Assignee: PIONEER ENERGY SERVICES CORP., San Antonio, TX (US)

( * ) Notice: Subject to any disclaimer, the term of this patent is extended or adjusted under 35 U.S.C. 154(b) by 105 days.

(21) Appl. No.: 15/503,067

(22) PCT Filed: Aug. 11, 2015

(86) PCT No.: PCT/US2015/044715

§ 371 (c)(1),
(2) Date: Feb. 10, 2017

(87) PCT Pub. No.: WO2016/025521

PCT Pub. Date: Feb. 18, 2016

(65) Prior Publication Data

US 2017/0234079 A1 Aug. 17, 2017

Related U.S. Application Data

(60) Provisional application No. 62/035,629, filed on Aug. 11, 2014.

(51) Int. Cl.
*E21B 7/02* (2006.01)
*E21B 15/00* (2006.01)
(Continued)

(52) U.S. Cl.
CPC ..... *E21B 15/00* (2013.01); *B66F 7/065* (2013.01); *B66F 7/0608* (2013.01); *B66F 7/12* (2013.01);
(Continued)

(58) Field of Classification Search
CPC ..... B66F 7/065; B66F 7/0608; B66F 7/12; B66F 7/14; B66F 2700/05; E04H 12/345; E21B 15/00; E21B 15/003; E21B 19/15
(Continued)

(56) References Cited

U.S. PATENT DOCUMENTS 4,569,168 A 2/1986 McGovney et al.
6,374,764 B1 * 4/2002 Davenport, III ..... B63B 9/065 114/265
(Continued)

FOREIGN PATENT DOCUMENTS

DE 102012209988 A1 10/2013

OTHER PUBLICATIONS

Authorized Officer Pieter Nijhuijs; Invitation to Pay Additional Fees with Partial International Search; dated Feb. 8, 2016, 8 pages.
(Continued)

*Primary Examiner* — Joshua J Michener
*Assistant Examiner* — James J Buckle, Jr.
(74) *Attorney, Agent, or Firm* — Dickinson Wright PLLC; Ross Spencer Garsson

(57) ABSTRACT

An improved system and method for bracing, transporting, assembling, and disassembly of drilling equipment at oil and gas land-based well sites. The system has a substructure with side boxes support bracing that are in a scissor jack (or grand plié) style bracing with telescoping tension link(s), linking pins, and vertical hydraulic cylinders. These linking pins are set after raising the substructure and secure the telescoping tension link, support arms, and support bracing in place to
(Continued)

maintain the integrity of the substructure. Alternatively the system has a substructure with side boxes support bracing that are in a scissor jack (or grand plié) style bracing with screw jacks and a means of stabilization during substructure raising. The substructure bracing reduces the overall length, reduces the upper and lower box spans, and balances the raising loads, subsequently lowering the transport weight of the side box such that a commercial walking system may be integrated into the side box and remain there during transport while maximizing the operating drill floor height while minimizing the transport height.

35 Claims, 16 Drawing Sheets

(51) Int. Cl.

| | |
|---|---|
| ***B66F 7/06*** | (2006.01) |
| ***B66F 7/12*** | (2006.01) |
| ***B66F 7/14*** | (2006.01) |
| ***E04H 12/34*** | (2006.01) |
| ***E21B 19/15*** | (2006.01) |

(52) U.S. Cl.
CPC ..... *B66F 7/14* (2013.01); *E04H 12/345* (2013.01); *E21B 7/02* (2013.01); *E21B 15/003* (2013.01); *E21B 19/15* (2013.01); *B66F 2700/05* (2013.01)

(58) Field of Classification Search
USPC ..... 52/651.05
See application file for complete search history.

(56) References Cited

U.S. PATENT DOCUMENTS

| | | | | |
|---|---|---|---|---|
| 7,931,076 | B2 * | 4/2011 | Ditta | E21B 15/00 166/75.11 |
| 8,468,753 | B2 * | 6/2013 | Donnally | E21B 7/02 173/186 |
| 8,516,751 | B2 | 8/2013 | Konduc et al. | |
| 8,959,874 | B2 * | 2/2015 | Wasterval | E21B 7/021 52/117 |
| 9,091,125 | B2 * | 7/2015 | Konduc | E21B 15/00 |
| 2004/0240973 | A1 * | 12/2004 | Andrews | E21B 7/02 414/332 |
| 2009/0188677 | A1 | 7/2009 | Ditta et al. | |
| 2013/0269268 | A1 | 10/2013 | Thiessen et al. | |
| 2014/0158342 | A1 | 6/2014 | Smith et al. | |
| 2017/0328081 | A1 * | 11/2017 | Trevithick | E04H 12/187 |

OTHER PUBLICATIONS

Authorized Officer Nathalie DeGreef; International Search Report and Written Opinion; dated May 4, 2016; 20 pages.

* cited by examiner

DRILLING RIG AND METHOD OF USE

CROSS-REFERENCE TO RELATED PATENT APPLICATIONS

This application claims priority to: provisional U.S. Patent Application Ser. No. 62/035,629, filed on Aug. 11, 2014, entitled "Drill Rig And Method Of Use," which provisional patent application is commonly assigned to the Assignee of the present invention and is hereby incorporated herein by reference in its entirety for all purposes.

TECHNICAL FIELD

The present invention relates to the field of drilling wells, and more particularly, to an improved system and method for transporting and assembling drilling equipment at oil and gas land-based well sites.

BACKGROUND

The present invention relates to a drilling rig and associated method of use, including transportation, assembly, and operational benefits. Primary economic and safety concern related to land-based reserve development of oil and gas reserves is the expense of transporting and setting up drilling equipment at the well sites. Conventional drilling equipment for drilling oil and gas wells is heavy and bulky, making transportation of the equipment difficult. Many remote sites lack adequate road systems for transporting heavy equipment, increasing the amount of time that the drilling equipment needs for transportation between drilling sites.

Logistic issues associated with transporting drilling equipment not only increases the cost of transportation, but increases the capital cost of an energy exploration and development project. For instance, conventional drilling equipment is an expensive capital investment that remains unused during transportation. Further, the workers that operate the drilling equipment are generally not engaged in their primary job function during transportation times. Thus, extended periods of time used to transport drilling equipment can drastically increase the overhead associated with a given well operation. This translates into thousands of dollars for an energy company that is attempting to develop energy reserves.

Moving extremely heavy loads has generally been a complicated task because of the large forces involved in lifting and transporting the heavy loads. When possible, large loads are often transported by disassembling or breaking up the load into multiple smaller loads. However, this break-down and subsequent reassembly process can be very time consuming, especially when a heavy load is only to be moved a small distance, or needs to be repositioned.

For heavy loads that need periodic movement or adjustment, devices commonly referred to as "walking systems" were developed. Walking systems typically have multiple "pods," "feet," or "stompers." These machines typically move the heavy loads over small distances in incremental stages without disassembly of the drilling systems. Walking systems are particularly useful for moving drilling systems where multiple wells are relatively closely spaced on a single pad thus allowing multiple wells to be drilled without rigging down or disassembling the rig.

Instead of using wheels driven by rotational forces to move heavy loads, walking machines typically use hydraulic lift cylinders to lift the load above a supporting surface, and then move or rotate the load relative to the supporting surface by pushing or pulling the load with hydraulic cylinders in combination with rollers or tracks in the walking machines. U.S. Pat. No. 5,921,336, issued Jul. 13, 1999, to Reed, discloses and teaches a walking structure device having a drilling rig substructure. U.S. Pat. No. 6,581,525, issued Jun. 24, 2003, issued to Smith, shows elongated beams under several rollers and lift cylinders, which allows the load from the lift cylinders and rollers to be spread over a large area.

Another important consideration to drilling operations is the safety of the personnel performing the operations. Drilling has inherent risks and hazards, and these are increased by transportation of the drilling equipment over significant distances. Safety considerations can shut down drilling operations if, for instance, essential drilling equipment becomes impaired or inoperable, or is just plain missing. When the drilling equipment is transported over extensive distances, essential equipment can easily be forgotten or misplaced. Further, safety is of extreme importance at remote sites, which typically are located large distances from medical assistance.

Accordingly, in the drilling industry, it is desirable to have a substructure and mast of a drilling system that: (a) moves quickly (i.e., breaks down into as few components as possible and transports easily with respect to individual package sizes/dimension (height, width, length, weight, etc.); (b) assembles quickly; (c) has a rig floor height to accommodate the various blowout preventers (BOPS) and rotating head assembly heights (nominally around 25 feet for maximum flexibility); (d) accommodates multiple well pads (including adapted for walking); and (e) disassembles quickly.

Design styles for drilling systems with substructures directed to achieve these desired attributes include (a) box-on-box substructures (such as disclosed in U.S. Pat. No. 6,161,358, issued Dec. 19, 2000, to Mochizuki et al.); (b) self-elevating telescoping box-on-box substructure (such as the National Oilwell Varco (Houston, Tex.) Box-In-Box substructure) or the Unit Drilling (Oklahoma City, Okla.) BOSS Rig substructure); (c) self-elevating parallelogram swing up winch or cylinder raised substructure with cantilevered drawworks raised mast (such as the National Oilwell Varco DRECO Slingshot drilling rig substructure); (d) self-elevating telescoping columns substructure with telescoping cylinder raised mast (such as the National Oilwell Varco Cabot and IRI 1500 substructures); and (e) self-elevating parallelogram swing up cylinder raised substructure with cantilevered cylinder raised mast (such as the Helmerich & Payne (Tulsa, Okla.) FlexRig3 drilling rig).

U.S. Pat. No. 4,569,168, issued Feb. 11, 1986, to McGovney et al., discloses and teaches a substructure for an oil derrick that includes a base frame, a top frame, and an intermediate bifurcated support frame (a pair of horizontally extending traveling frames). A linkage network of swingable leg members intercouples the base and traveling and top frames for movement in parallelism between collapsed and elevated conditions of the substructure. In the collapsed mode, the frame members are positioned in an adjacent relationship for presenting a low profile to a flatbed truck that allows a portable oil rig to be easily shifted onto the top frame and into alignment with the oil wellhead below. A block and tackle assembly operably engages the traveling frames and is coupled to the derrick hook carried by the traveling block of the oil derrick. Upon operation of the latter, the swingably mounted traveling frames move towards each other causing an elevation of the top frame so as to present a working space between the elevated oil derrick and oil wellhead. The traveling frames are locked one to the other to maintain the top frame at its elevated position with collapsible end sway braces precluding lateral shifting of the top frame and oil rig thereon. To relocate the rig at another site, the traveling frames are unlocked, which causes a load induced, downward movement of the swingable leg members and associated frames toward their collapsed position with a hydraulic buffer assembly regulating the speed of movement of the traveling frames (and thus the collapsing speed of the entire substructure).

There remains a need for a well-drilling system and method that is easy and less expensive to assemble and disassemble for transportation between land-based drilling sites.

There also remains the need for a well-drilling system and method that supports multi-well development pads. There also remains a need for a well-drilling system and method that is adapted for moving using a walking system without disassembly.

There also remains a need for a well-drilling system and method that provides increased safety for drilling operations.

SUMMARY OF THE INVENTION

The present invention is an improved system that reduces the number of loads and simplifies assembling and disassembling drilling equipment at oil and gas land-based well sites. The substructure has side boxes support bracing that are in a "scissor jack" (or "grand plié") style bracing and has a telescoping tension link and two opposing vertical cylinders (or screw jacks in place of the telescoping tension links and cylinders). The tension link secures the opposing link pins and support arms and bracing to maintain the integrity of the sub structure.

This substructure bracing reduces the transport weight of the side box by reducing the length of the side box to be as short as possible, provides lateral support and break up spans at top/bottom boxes, balances the raising loads to reduce bending in the structure members, and still allows a drill floor operating elevation of approximately 25 feet to be attained with a transport height of approximately 10½ feet (or less). The reduced weight also allows a commercial walking system (such as a walking system of Entro Industries (Hillsboro, Oreg.), Columbia Industries (Hillsboro, Oreg.), etc.) to be integrated into the side box and remain there during transport reducing the number of transport loads and reducing the assembly/disassembly required activities. In embodiments of the present invention, the bracing should allow space for the walking systems' vertical cylinders when the substructure is lowered (i.e., squatted) for transport In general, in one aspect, the invention features a system for land-based drilling operations. The system includes a substructure operable for moving between a transport position and an operating position. The substructure includes a first side box including (i) a first side box upper portion having a top end, (ii) a first side box lower portion, and (iii) a first side box scissor jack support and bracing system connected to the first side box upper portion and the first side box lower portion. The substructure further includes a second side box including (i) a second side box upper portion having a top end, (ii) a second side box lower portion, and (iii) a second side box scissor jack support and bracing system connected to the second side box upper portion and the second first side box lower portion. The substructure further includes a center section connecting the first side box upper portion and the second side box upper portion. The center section has a top end. The substructure further includes a floor positioned at or near the top ends of the first side box, the second side box, and the center section. The floor is in a substantially level position. The first side box upper portion and the first side box lower portion are operable to move up and down relative to each as the substructure moves between the transport position and the operating position. The second side box upper portion and the second side box lower portion are operable to move up and down relative to each as the substructure moves between the transport position and the operating position. The first side box scissor jack support and bracing system and the second side box scissor jack support and bracing system are operable to maintain the floor in the substantially level position as the substructure moves between the transport position and the operating position.

Implementations of the invention can include one or more of the following features.

The system can further include at least one first linking pin that is operable for locking the first side box scissor jack support and bracing system in position such that the first side box upper portion and the first side box lower portion are not operable to move up and down relative to each when the at least one first linking pin is inserted in the first side box scissor jack support and bracing system. The system can further include at least one second linking pin that is operable for locking the second side box scissor jack support and bracing system in position such that the second side box upper portion and the second side box lower portion are not operable to move up and down relative to each when the at least one second linking pin is inserted in the second side box scissor jack support and bracing system.

The first side box scissor jack support and bracing system can include (i) a first upper support arm, (ii) a first lower support arm, (iii) first upper support bracing, and (iv) first lower support bracing. The second side box scissor jack support and bracing system can include (i) a second upper support arm, (ii) a second lower support arm, (iii) second upper support bracing, and (iv) second lower support bracing.

The system can further include a hydraulic system operable for moving the substructure between the transport position and the operating position.

The hydraulic system can include a telescoping tension link and a plurality of cylinders operable to lift and lower (a) the first side box upper portion relative to the first side box lower portion and (b) the second side box upper portion relative to the second side box lower portion.

The system can further include a screw jack system operable for moving the substructure between the transport position and the operating position.

The substructure can have a transport height of at most 10½ feet when the substructure is in the transport position. The substructure can have a floor height of at least 22 feet when the substructure is in the operating position.

The system can further include a walking system operable for moving the system for land-based operations while the substructure is in the operating position.

The walking system can include a plurality of hydraulic lift cylinders.

The system can further include a mast set at or near the floor of the substructure.

The system can further include a walking system operable for moving the system for land-based operations while the substructure is in the operating position while the mast is set at or near the floor of the substructure.

The system can further include a mud boat position on a side of the substructure.

The system can further include a catwalk positioned on the mud boat.

In general, in another aspect, the invention features a method that includes setting a system for land-based drilling operations at a first location at which drilling operations are to occur. The system for land-based drilling operations includes a substructure. The substructure includes a first side box. The first side box includes (A) a first side box upper portion having a top end, (B) a first side box lower portion, and (C) a first side box scissor jack support and bracing system connected to the first side box upper portion and the first side box lower portion. The substructure further includes a second side box. The second side box includes (A) a second side box upper portion having a top end, (B) a second side box lower portion, and (C) a second side box scissor jack support and bracing system connected to the second side box upper portion and the second first side box lower portion. The substructure further includes a center section connecting the first side box upper portion and the second side box upper portion. The center section has a top end. The substructure further includes a floor positioned at or near the top ends of the first side box, the second side box, and the center section. The floor is in a substantially level position. The substructure is in a first position. The method further includes moving the substructure from the first position to a second position while maintaining the floor in the substantially level position. The first side box upper portion is raised relative to the first side box lower portion. The second side box upper portion is raised relative to the second side box lower portion. The method further includes locking the substructure in the second position.

Implementations of the invention can include one or more of the following features.

The method can further include setting a mast at or near the floor.

The method can further include assembling the mast apart from the substructure at the same time the substructure is being moved from the first position to the second position.

The method can further include performing the drilling operations at the first location using the system for land-based drilling operations.

The method can further include moving the system for land-based drilling operations from the first location to a second location at which second drilling operations are to occur. The substructure can remain in the second position during the step of moving.

The method can further include moving the system to the first location while the substructure is in the first position. The substructure can have a transport height of at most 10½ feet when the substructure is in the first position. The substructure can have a floor height of at least 22 feet when the substructure is in the second position.

The step of moving the substructure from the first position to the second position can include using a hydraulic system.

The hydraulic system can include a plurality of hydraulic cylinders and telescoping tension links. The step of using the hydraulic system can include extending the hydraulic cylinders to raise (i) the first side box upper portion relative to the first side box lower portion and (ii) the second side box upper portion relative to the second side box lower portion, while keeping the floor substantially level until the second position is attained. The method can further include retracting the hydraulic cylinders after the step of locking the substructure in the second position.

The step of locking the substructure in the second position can include installing a plurality of linking pins that lock in place the telescoping tension links, first side box scissor jack support and bracing system, and second side box scissor jack support and bracing system.

The step of moving the substructure from the first position to the second position can include using a screw jack system.

The screw jack system can include at least one screw jack. The step of using the screw jack system can include rotating the at least one screw jack to cause (i) first support arms and first support bracing in the first side box scissor jack support and bracing system to raise the first side box upper portion relative to the first side box lower portion and (ii) second support arms and second support bracing in the second side box scissor jack support and bracing system to raise the second side box upper portion relative to the second side box lower portion, while keeping the floor substantially level until the second position is attained.

The method can further include using a boost cylinder to assist in raising the floor of the substructure while rotating the at least one screw jack.

The method can further include unlocking the substructure in the second position. The method can further include moving the substructure from the second position to the first position. The method can further include transporting the system for land-based drilling operations to a different location while the substructure is in the first position.

The method can further include detaching and lowering the mast to the ground before the step of moving the substructure from the second position to the first position. The method can further include disassembling the mast at the same time the substructure is being moved from the second position to the first position.

In general, in another aspect, the invention features a method that includes setting a system for land-based drilling operations at a first location at which drilling operations are to occur. The system for land-based drilling operations includes a substructure in a transport position and an operating floor located at or near the top of the substructure. The method further includes moving the substructure from the transport position to an operating position. The method further includes raising a mast to the operating floor using a mast elevator. The method further includes setting the mast at or near the operating floor. The method further includes raising the mast to an operating configuration of the mast.

Implementations of the invention can include one or more of the following features.

The step of raising the mast to the operating floor using a mast elevator can include using one or more mast raising cylinders in conjunction with a ramp.

The step of raising the mast to the operating floor using a mast elevator can include using one or more mast raising cylinders in conjunction with a mast elevator link.

The step of raising the mast to the operating configuration of the mast can include using the mast elevator.

The step of setting the mast at or near the operating floor can occur when the substructure is in the operating position.

The step of setting the mast at or near the floor can occur when the substructure is in the transport position.

The method can further include locking the substructure in the operating position.

DETAILED DESCRIPTION

The present invention relates to the field of drilling wells, and more particularly, to an improved system that reduces the number of loads and simplifies assembling and disassembling drilling equipment at oil and gas land-based well sites.

Substructure

Figure 1:
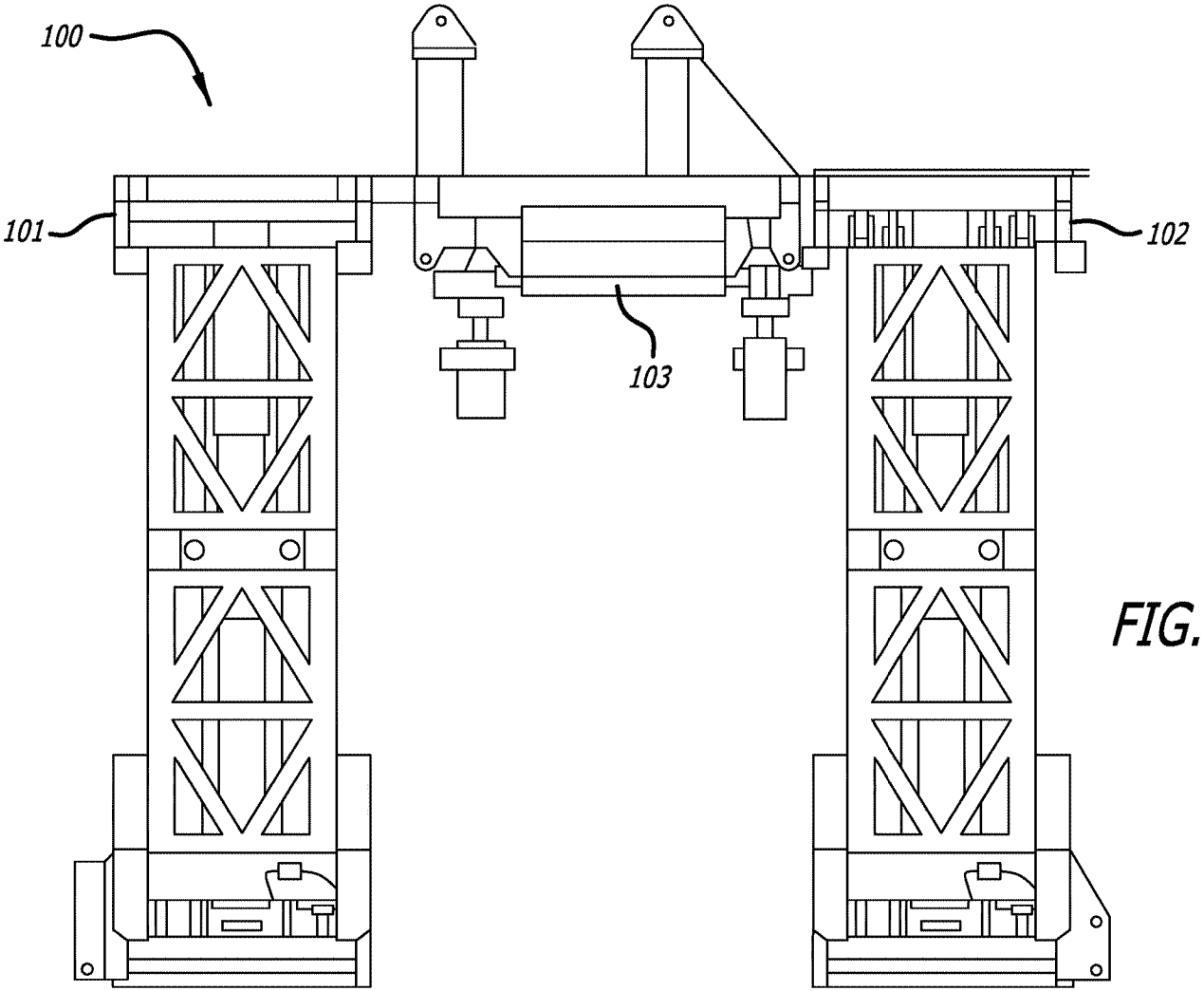
FIG. 1 illustrates an embodiment of the present invention in which the substructure is in the operating position.
Figure 2A:
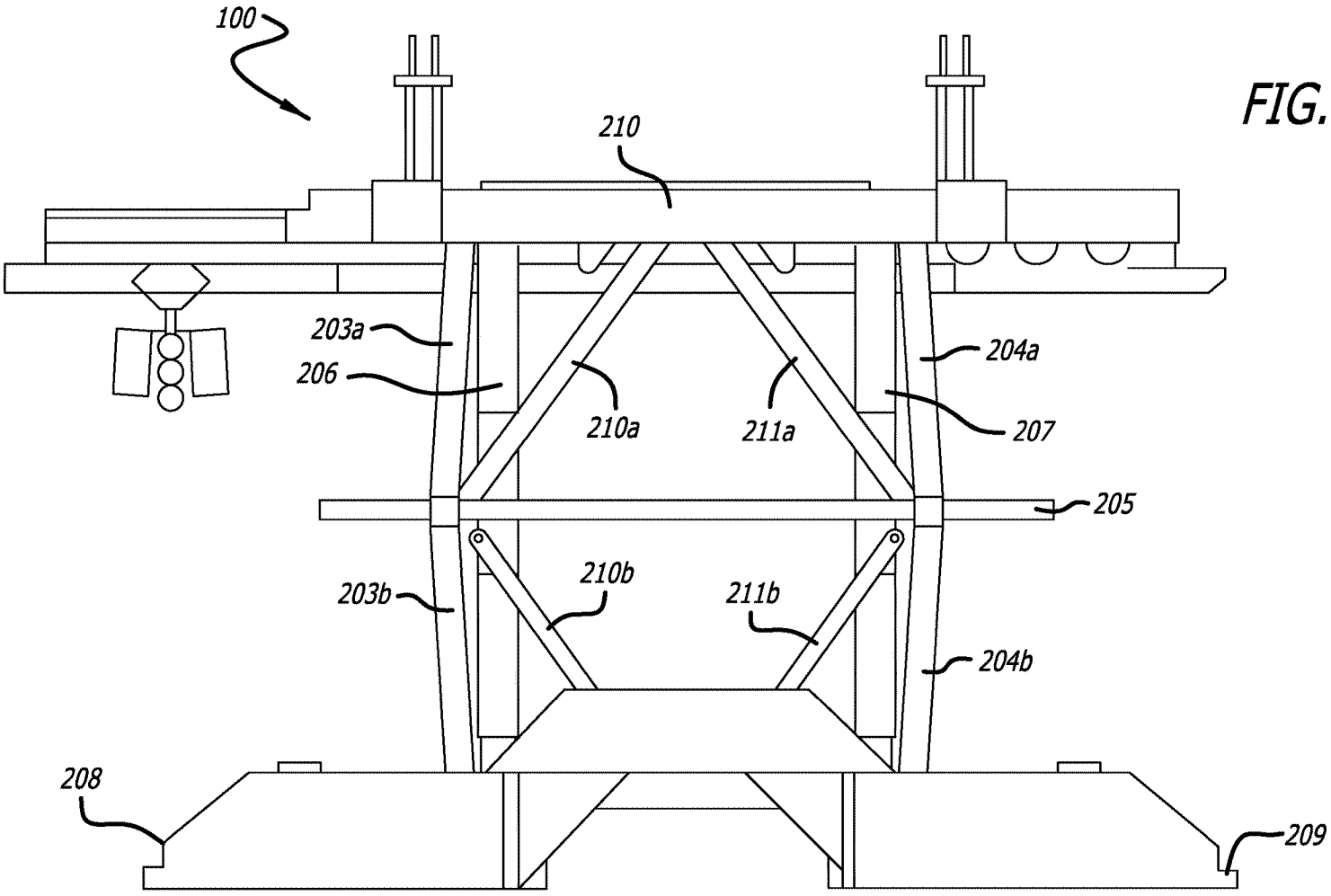
FIG. 2A illustrates a right side elevation view of the embodiment of FIG. 1.
Figure 2B:
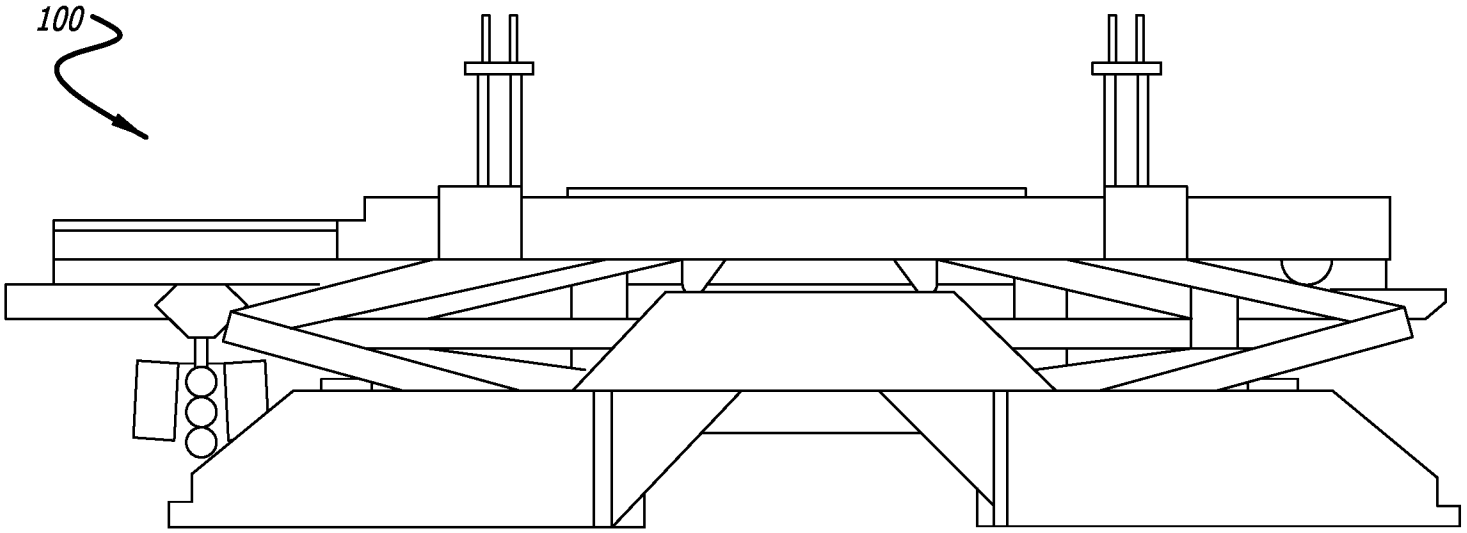
FIG. 2B illustrates the embodiment illustrated in FIGS. 1 and 2A in which the substructure is in the transport position.

FIG. 1 illustrates a substructure 100 that includes two side boxes 101, 102 and a center-steel section 103. Referring to FIGS. 2A-2B, the substructure 100 of the present invention is also shown. FIG. 2A shows substructure 100 in its operating position (right side elevation view of substructure 100 shown in FIG. 1). Side boxes 101, 102 (shown in FIG. 1 and hidden in the right side elevation view of FIG. 2A) are maintained in a level position by support arms and bracing (upper support arm 203*a*, 204*a*, lower support arm 203*b*, 204*b*, upper support bracing 210*a*, 211*a*, and lower support bracing 210*b*, 211*b*) that are in a scissor jack (or grand plié) style bracing. The support arms (203*a*, 203*b*, 204*a*, 204*b*) and braces (210*a*, 210*b*, 211*a*, 211*b*) are secured in position by pinning the telescoping tension link 205 to the support arms and braces after which the two opposing cylinders 206 and 207 are not required for support and may be retracted.

The opposing cylinders 206, 207 can be hydraulic cylinders that are utilized to raise and lower the substructure (between its transport and operating positions). Alternatively, the raising/lowering can be effectuated by other mechanism, such as by the rotation of a screw jack which would replace the telescoping tension link. (This would be similar to the mechanism by which a car jack is expanded for lifting purposes). If a screw jack is alternatively used instead of the telescoping tension link and hydraulic cylinders 206, 207, the use of hydraulic cylinders 206, 207, and pinning of the support arms after raising are not required (but optionally can still be utilized).

The linking pins secure the telescoping tension link 205 to the support arms and bracing (upper support arms 203*a*, 204*a* and braces 210*a*, 211*a* and lower support arms 203*b*, 204*b* and braces 210*b*, 211*b*) locking and holding them in place to maintain the integrity of the substructure. This substructure bracing configuration (a) (i) allows for reduced length of the side boxes 101, 102, (ii) provides lateral support, (iii) reduces the spans at the top and bottom boxes, and (iv) balances the raising loads which reduces bending in the top and bottom boxes, which reduces the weight such that the walking systems 301, 302 (shown in FIG. 3) can be left in the packages for transport and still be transported as a permitted load even with floor heights greater than 22 feet, and (b) allows a greater elevation differential between the transport elevation and operating elevation than current or historical system designs while minimizing the number of packages and reducing the assembly/disassembly required activities. Historical box-on-box substructures can be stacked up to any operating floor height but additional packages must be added as the floor height increases. Swing up or parallelogram substructures increase in length and weight as the floor height increases. Telescoping box substructures are limited on operating floor height based upon the transport elevation (the maximum operating floor height is nominally two times the shipping height less the overlap between the boxes when raised).

Figure 3:
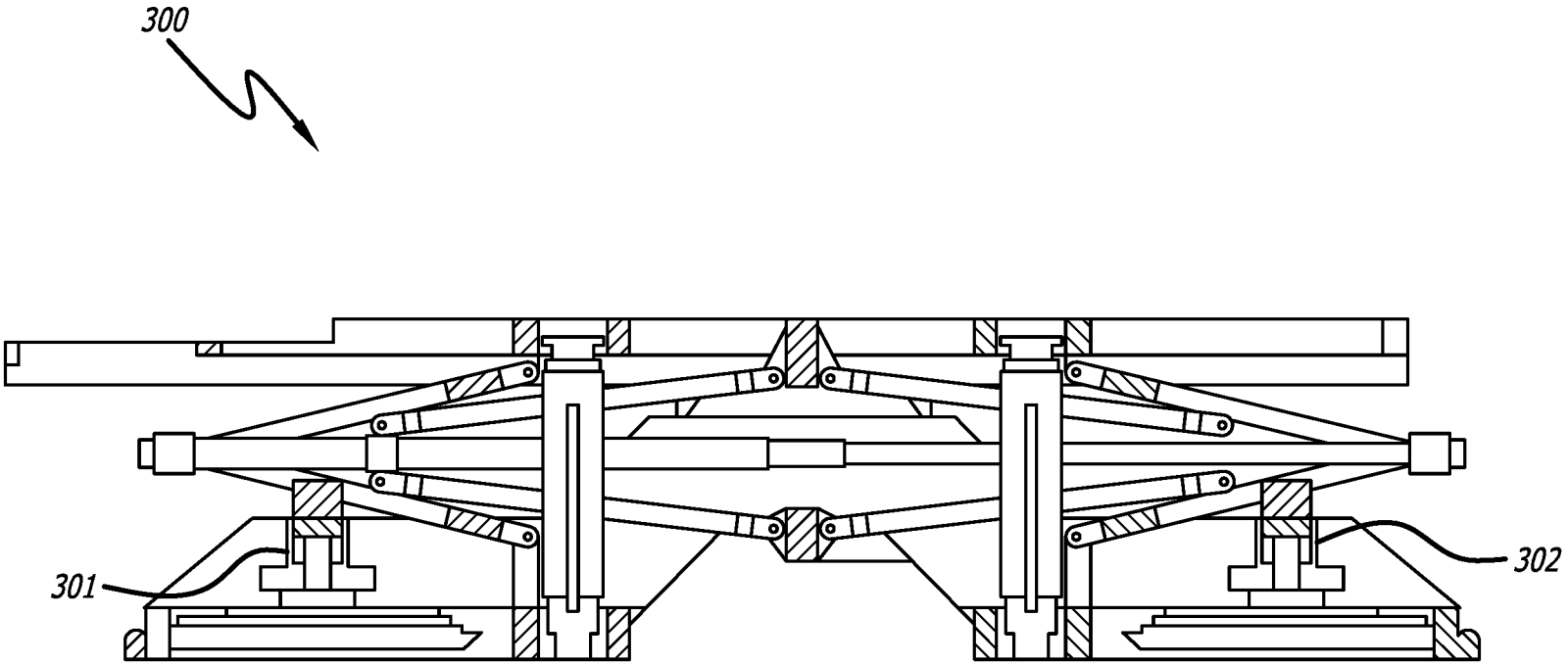
FIG. 3 illustrates an embodiment of the present invention in which the substructure is in the transport position and having walking systems.

FIG. 2B shows substructure 100 in its transport position. This substructure bracing reduces the length of the side boxes resulting in a reduced weight such that a commercial walking system (such as a walking system of Entro Industries, Columbia Industries, etc.) may be integrated into the side box and remain there during transport. In embodiments of the present invention, the bracing should allow space for the walking systems' vertical cylinders when the substructure is lowered (i.e., squatted) for transport. FIG. 3 shows a substructure 300 similar to the substructure 100 that is in the transport position and has walking systems 301, 302 installed.

Stabilizing the substructure while raising from the transport position to the operating position can be accomplished through linkages, spur gears, worm gear, vertical hydraulic cylinders, or a combination thereof, as shown in FIGS. 4, 5, 6A, 6B, and 7.

Figure 4:
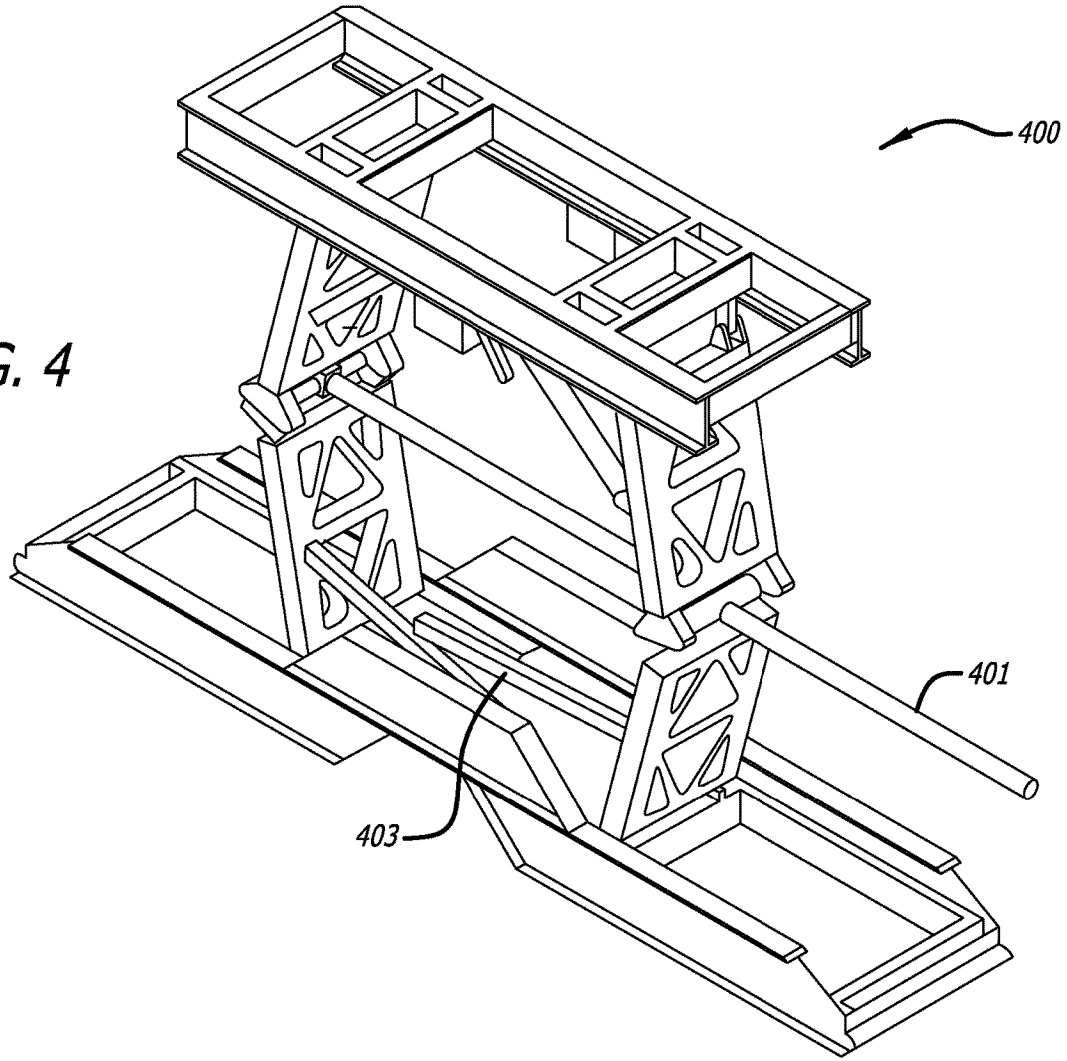
FIG. 4 illustrates an embodiment of the present invention having a single screw jack raising mechanism/tension link and linkages for stabilization.

FIG. 4 shows substructure 400 (in its operating position) having a single screw jack raising mechanism/tension link 401. A "boost" cylinder (typically a shorter vertical cylinder that raises the substructure to a predefined elevation to minimize "lift off loading" of the primary raising device) may optionally be utilized with the screw jack. The substructure also has linkages for stabilization 403. These linkages maintain the floor of the substructure at a substantially level position (i.e., stabilize the floor) during the raising of the substructure.

Figure 5:
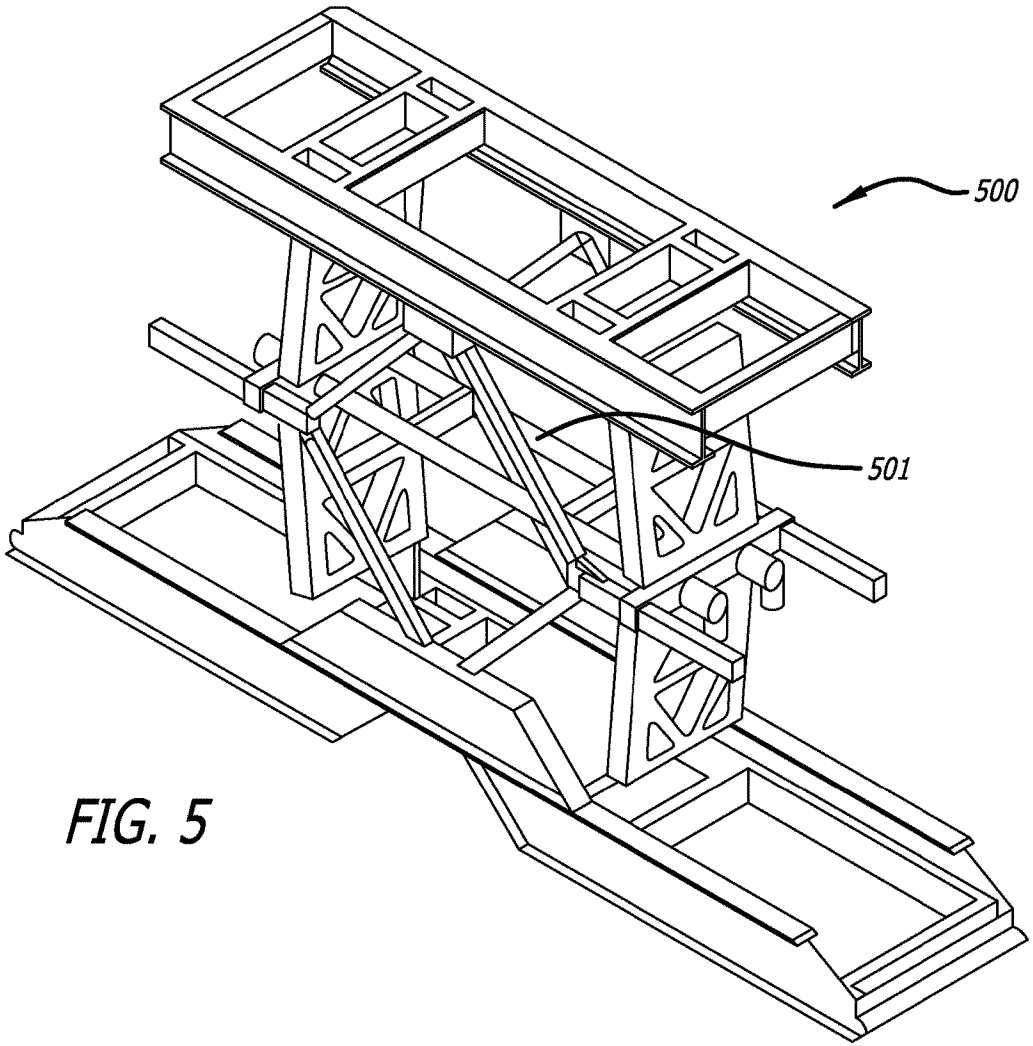
FIG. 5 illustrates an embodiment of the present invention having a dual or quad screw jack raising mechanism/tension link.

FIG. 5 shows substructure 500 (in its operating position) having a dual/quad screw jack raising mechanism/tension link 501. Having a dual or quad screw jack reduces the individual screw jack rod diameter and drive motor requirements and also adds transverse stability.

Figure 6B:
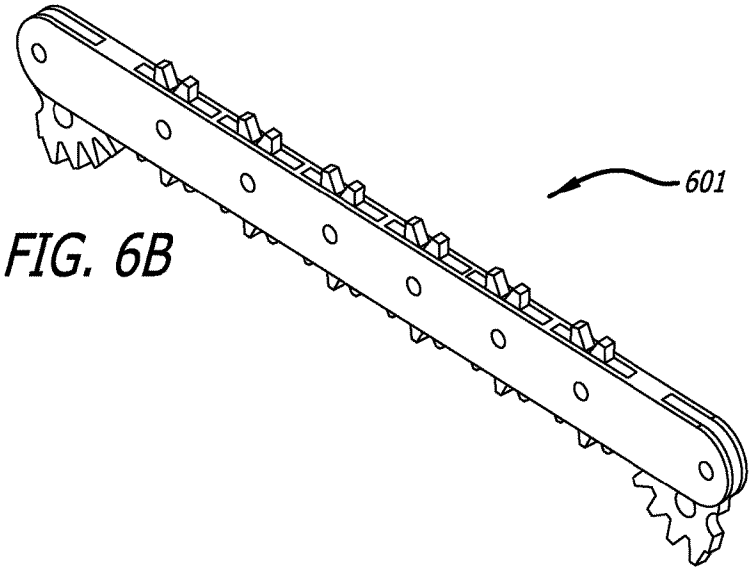
FIG. 6B illustrates the gears shown in FIG. 6A.
Figure 6A:
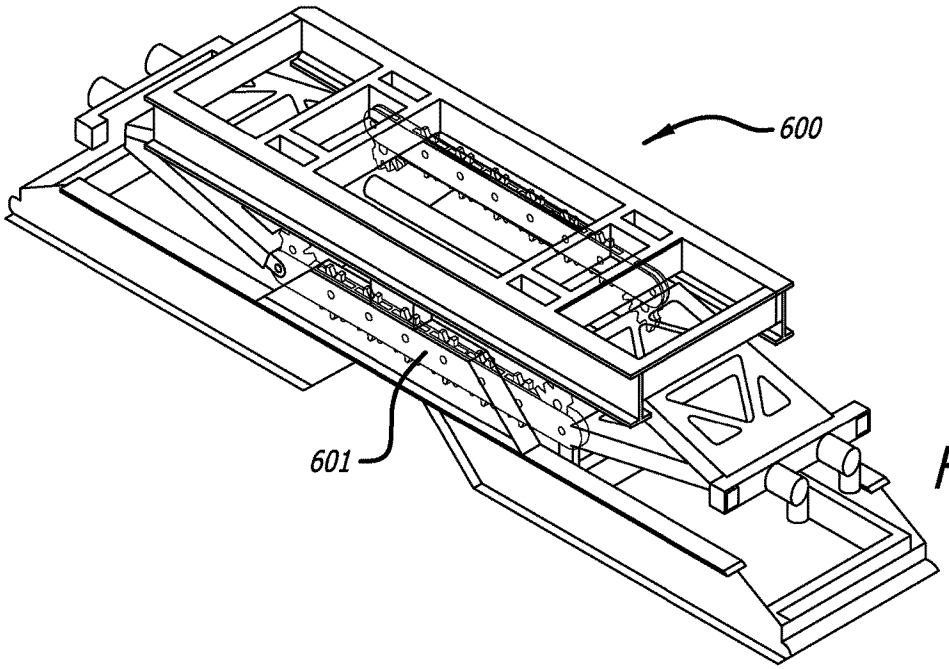
FIG. 6A illustrates an embodiment of the present invention having a dual or quad screw jack raising mechanism/tension link and gears for stabilization.
Figure 6C:
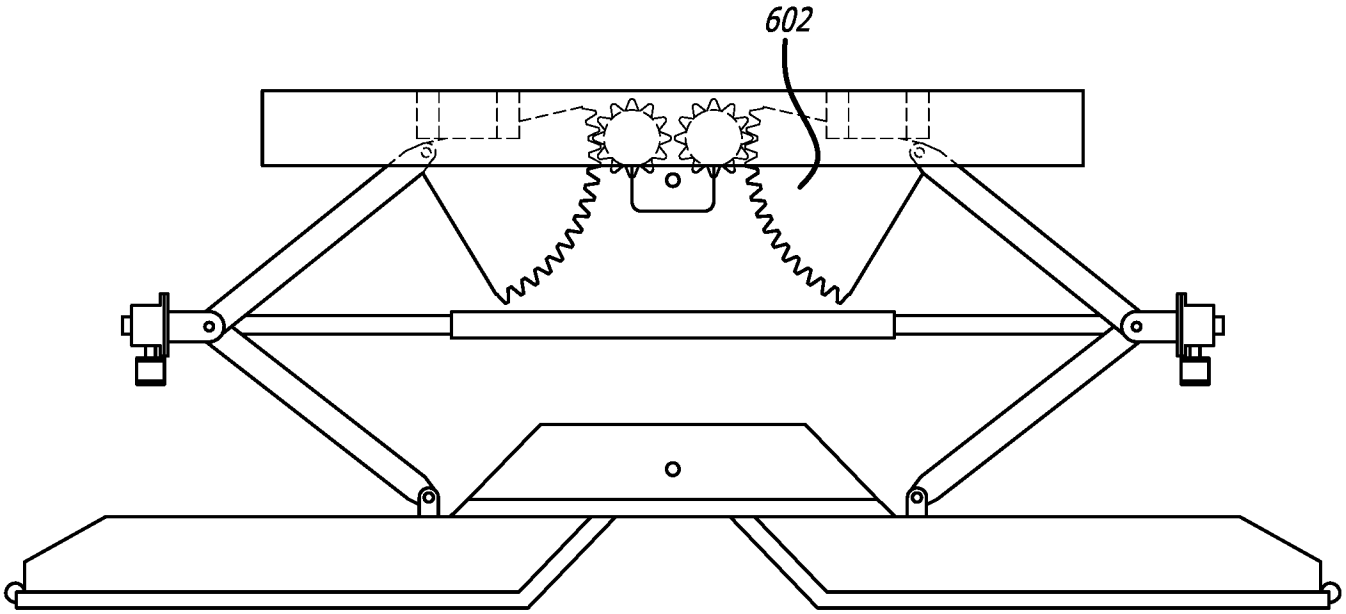
FIGS. 6C-6D illustrate alternative embodiments of the present invention having a dual or quad screw jack raising mechanism/tension link and gears for stabilization in which the gears are partial gears.
Figure 6D:
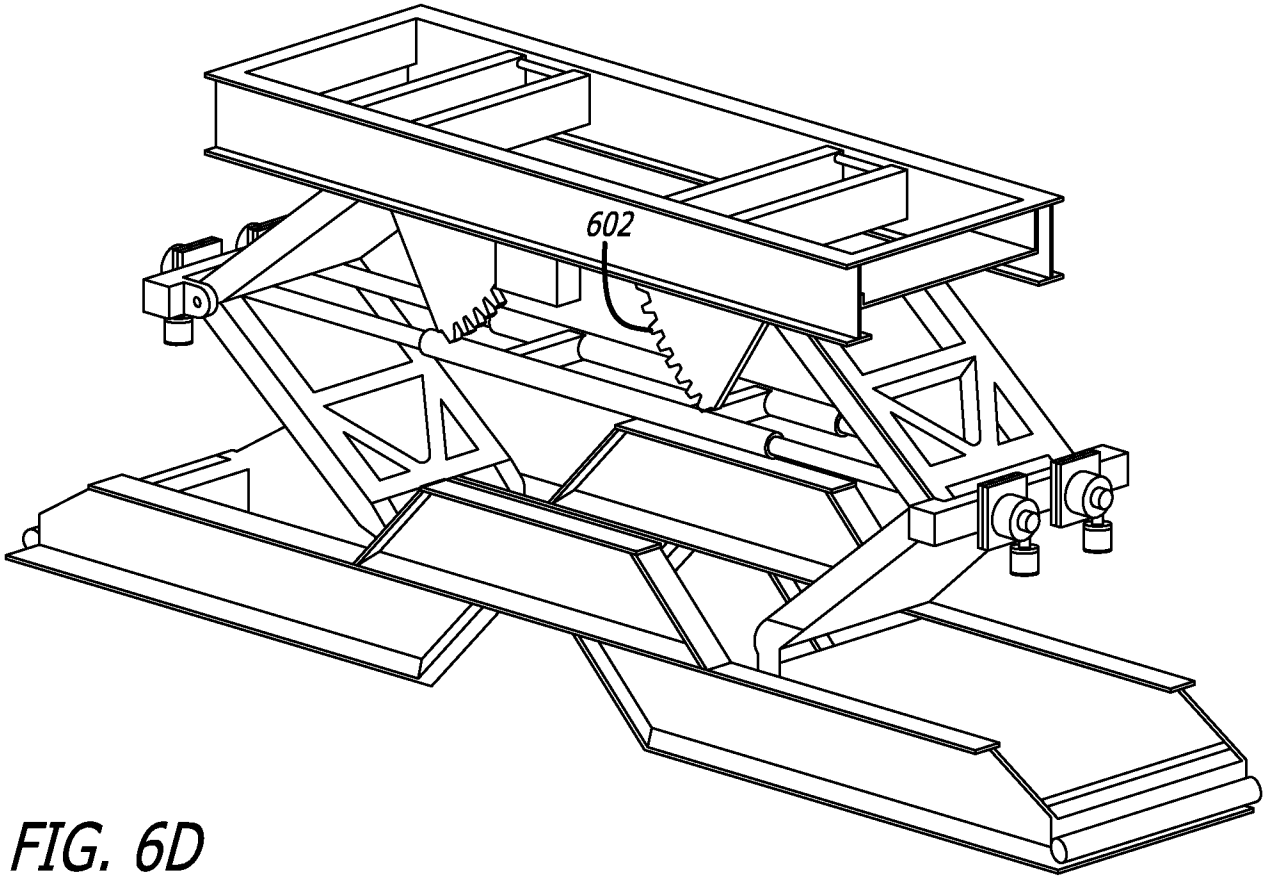

FIGS. 6A-6B shows substructure 600 (in its transport position) having a dual/quad screw jack raising mechanism and gears 601 for stabilization. As shown in FIG. 6B, the gears can be full gears. As shown in FIGS. 6C-6D, partial gears 602 can be alternatively or additionally utilized. These gears (gears 601 and partial gears 602) maintain the floor at a substantially level position (i.e., stabilize the floor) during the substructure raising (and lowering).

Figure 7:
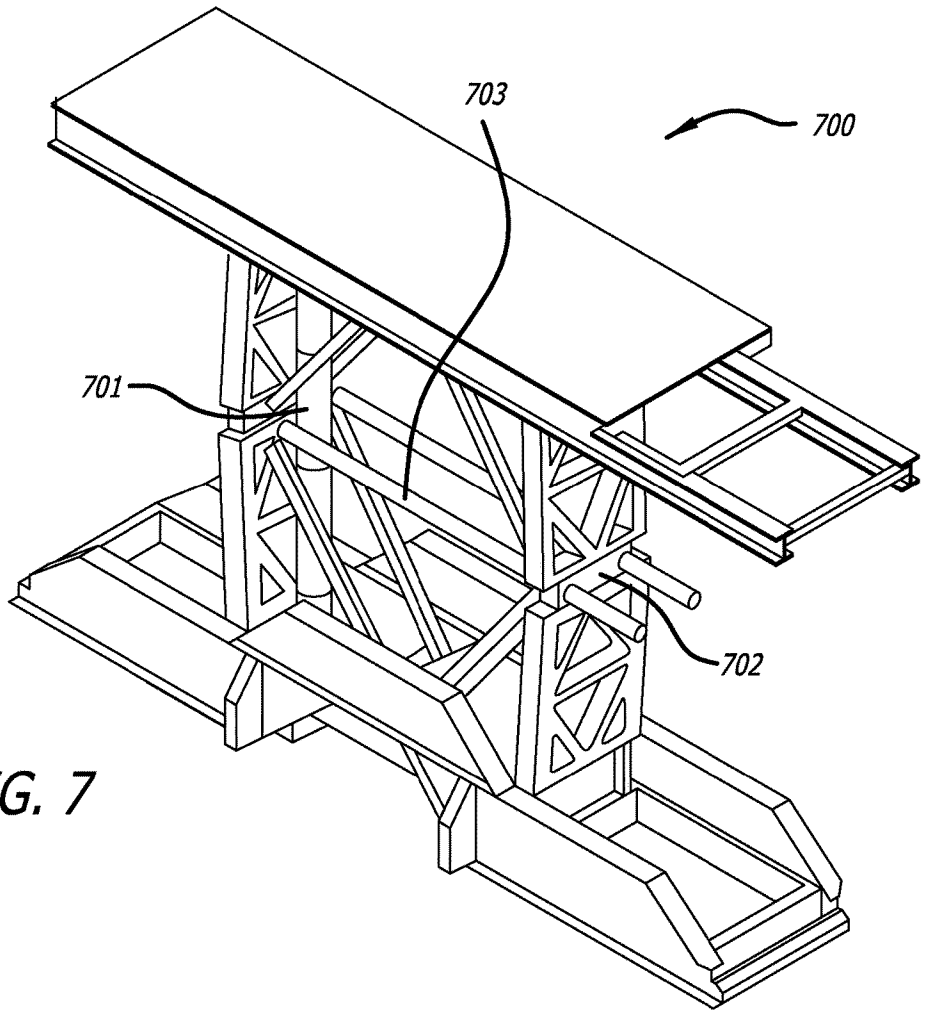
FIG. 7 illustrates an embodiment of the present invention having a hydraulic raising mechanism with telescoping tension link.

FIG. 7 shows substructure 700 (in its operating position) having a hydraulic raising mechanism (hydraulic cylinders 701, 702) with telescoping tension link 703.

Generally, the substructure would be made of materials standard in the art, such as high strength carbon steel.

Raising/Lowering of the Substructure

In embodiments of the present invention, the substructure can be raised with cylinders, such as utilizing the following steps:

1. Set and interconnect the substructure package.
2. Bleed hydraulic cylinders.
3. Extend the hydraulic cylinders keeping the drill floor level until the operating elevation is attained.
4. Install the linking pins, which lock the telescoping tension links and substructure support arms and bracing in place. (In some embodiments, the linking pins are hydraulically actuated, thus eliminating the need for personnel to manually interact with the substructure until it has been secured in the raised position).
5. Retract the substructure raising cylinder.

In embodiments of the present invention, the substructure can be alternatively (or additionally) raised with a screw jack, such as utilizing the following steps:

1. Set and interconnect the substructure packages.
2. Rotate the screw jack(s) in conjunction such that screw jacks retract thus contracting the arms and bracing thus raising the drill floor until the desired operating elevation is attained. Optionally, a boost cylinder (if present) can be used while rotating the screw jack(s) to assist in the raising of the drill floor. (In some embodiments, there is no need for personnel to manually interact with the substructure until it has been secured in the raised position).

In embodiments of the present invention, the substructure can be lowered (by cylinders and, additionally or alternatively, screw jack(s)) by reversing the steps set forth above.

Mast and Other Drilling System Structures

In addition to the substructure, the drilling rig includes other structures including, most notably, the mast. Typically, in embodiments of the present invention, the mast includes three sections with an integrated top drive system (TDS). When being transported to location (for rigging up), the mast sections are typically transported on dollies or transport skids. Alternatively the mast can be of any number of sections (or additionally), the mast can be telescoping.

Another structure of the drilling rig is the mud boat. The mud boat can be used to assist in mast installation alignment, to transport mast raising cylinders, and to house the mast ramps or mast elevator link, and provide a suitable geometric location/foundation to secure the mast raising cylinders fixed pin connection and resist the mast raising loads.

Raising/Lowering of the Mast

After the mast sections are interconnected, the mast may either be moved to or set on the rig floor before or after raising the substructure. Typically, the mast is moved to, or set on, the rig floor after raising the substructure which maximizes the time allowed to disassemble, move, and reassemble the mast without impacting the overall rig move duration. For instance, while the substructure is being raised, the mast can be assembled simultaneously (thus allowing two different activities to happen at the same time). Also for instance, before the substructure is lowered, the mast can be detached and lowered to the ground such that the mast can be disassembled simultaneous to the lowering of the substructure (thus again allowing two different activities to happen at the same time).

Figure 8A:
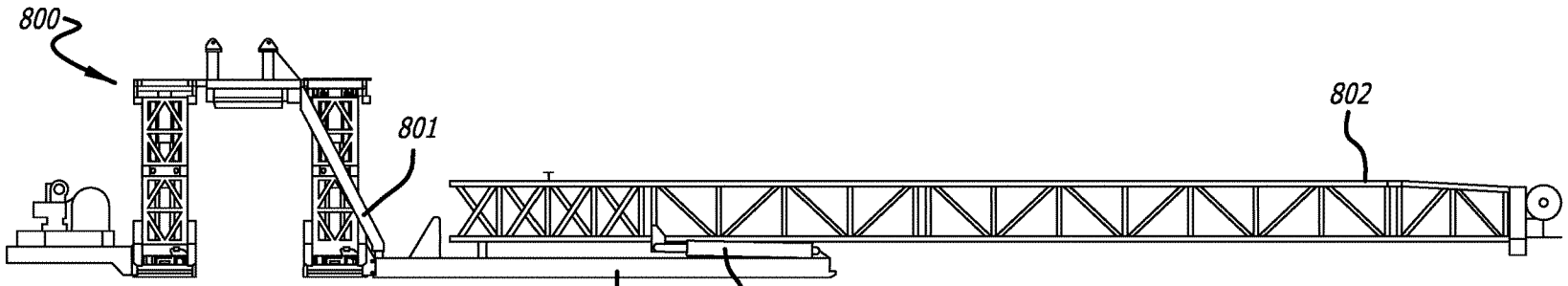
FIGS. 8A-8B illustrate setting the mast on the floor (after the substructure is raised to its operating position) using the mud boat and mast raising cylinders with ramps.
Figure 8B:
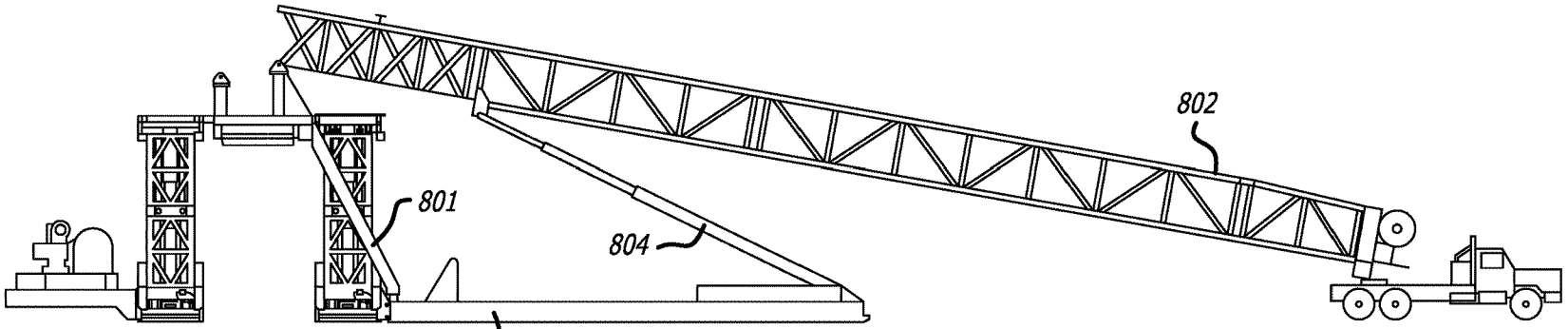
Figure 9A:
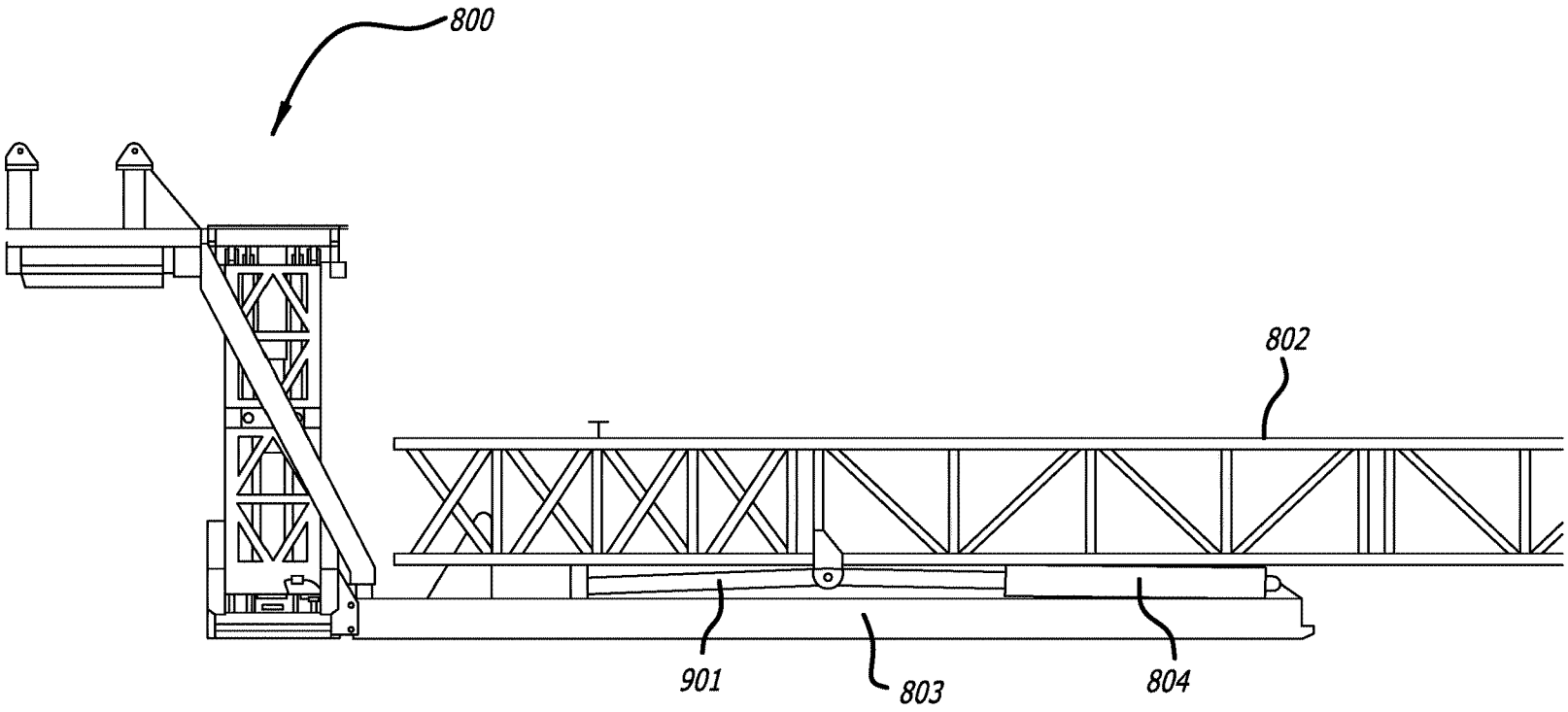
FIGS. 9A-9B illustrate setting the mast on the floor (after the substructure is raised to its operating position) using the mud boat and mast raising cylinders with a mast elevator link.
Figure 9B:
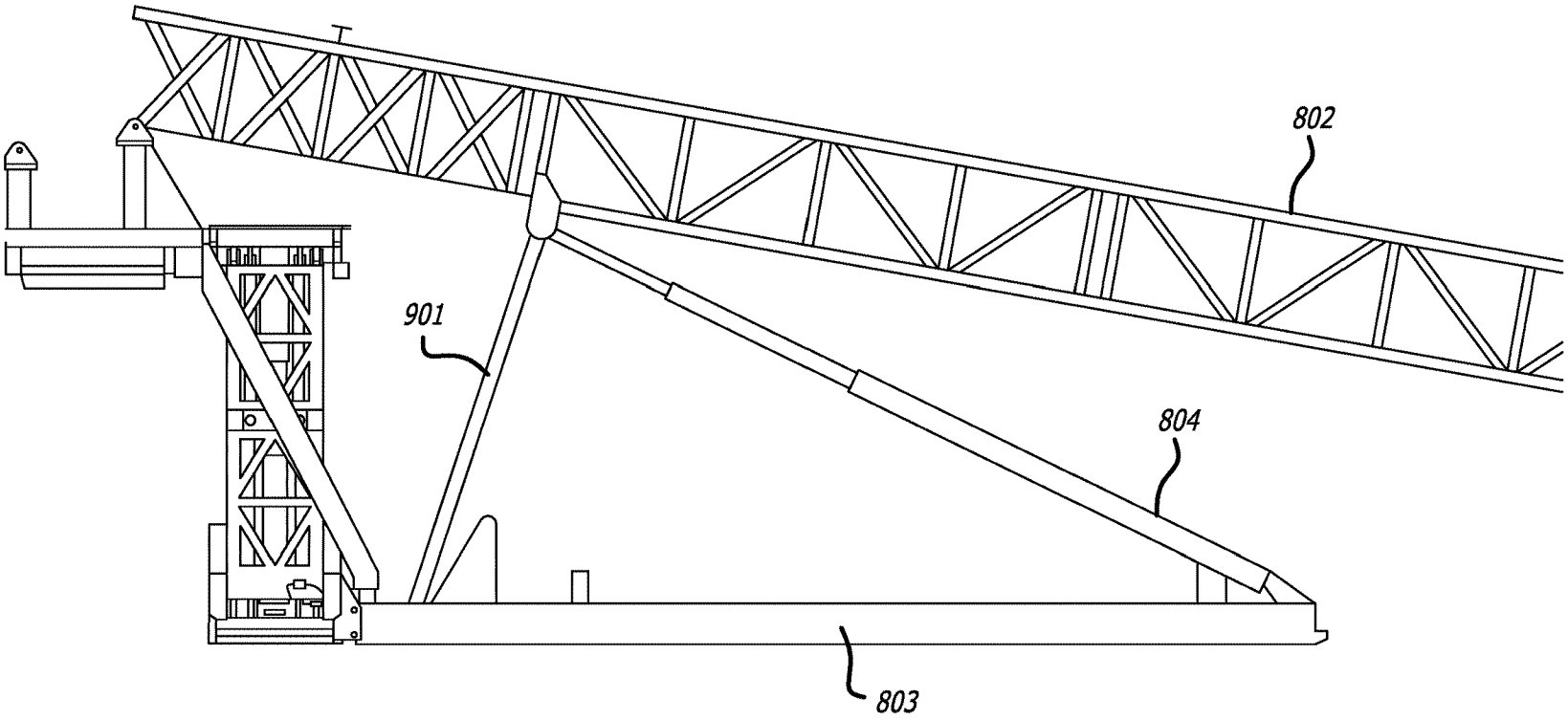

The mast is typically pushed up and onto the rig floor using the mast raising cylinders (MRC) in conjunction with ramps or a mast elevator link. FIGS. 8A-8B illustrate setting the mast 802 (after the substructure 800 is raised to its operating position) using the mud boat 803 and mast raising cylinders 804 with ramps 801. FIGS. 9A-9B illustrate setting the mast 802 (after the substructure 800 is raised to its operating position) using the mud boat 803 and mast raising cylinders 804 with a mast elevator link 901.

Figure 10:
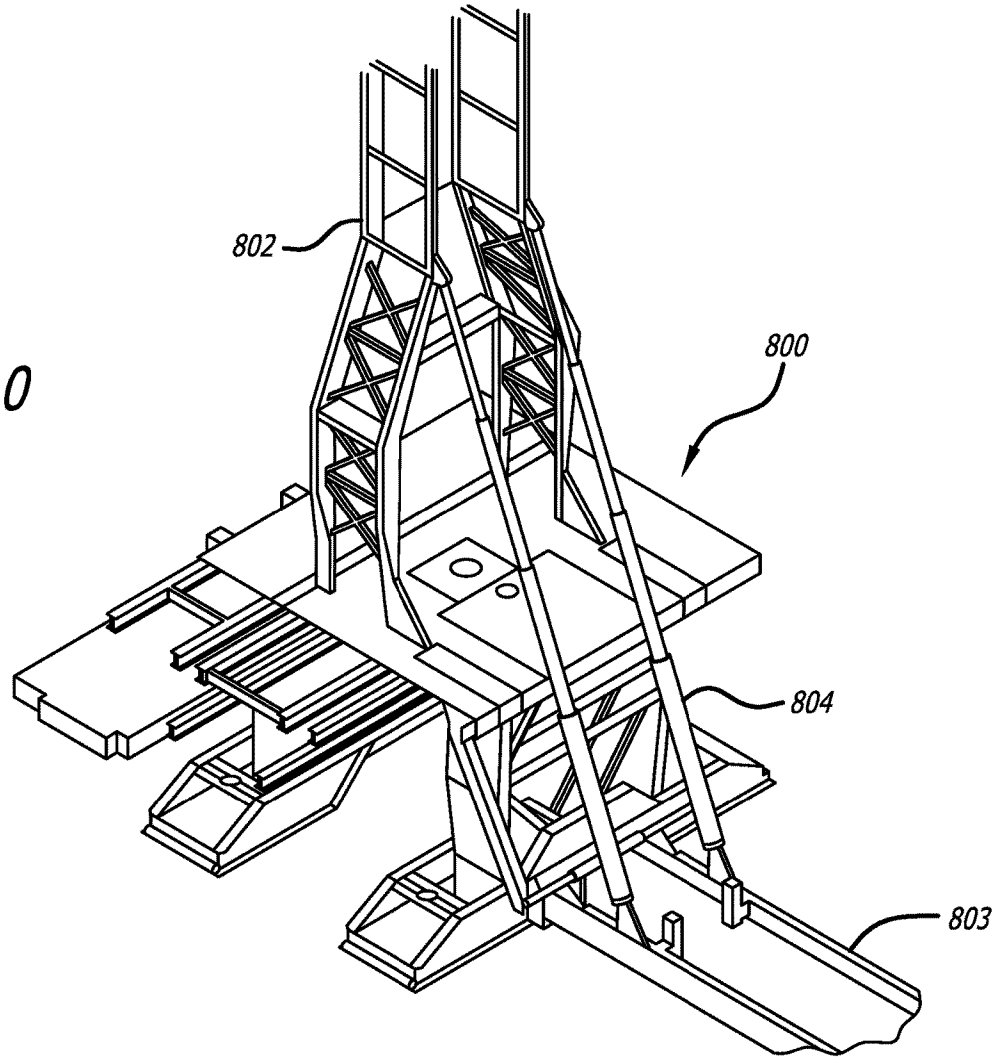
FIG. 10 illustrates the mast raised on the substructure (after the substructure is raised in its operating position) in which the mast raising cylinders are repositioned along the mud boat.

As shown in FIG. 10, once the mast 802 is on the rig floor of the substructure 800, the mast raising cylinders 804 are repositioned along the mud boat 803 and then the mast 802 is raised.

Figure 11A:
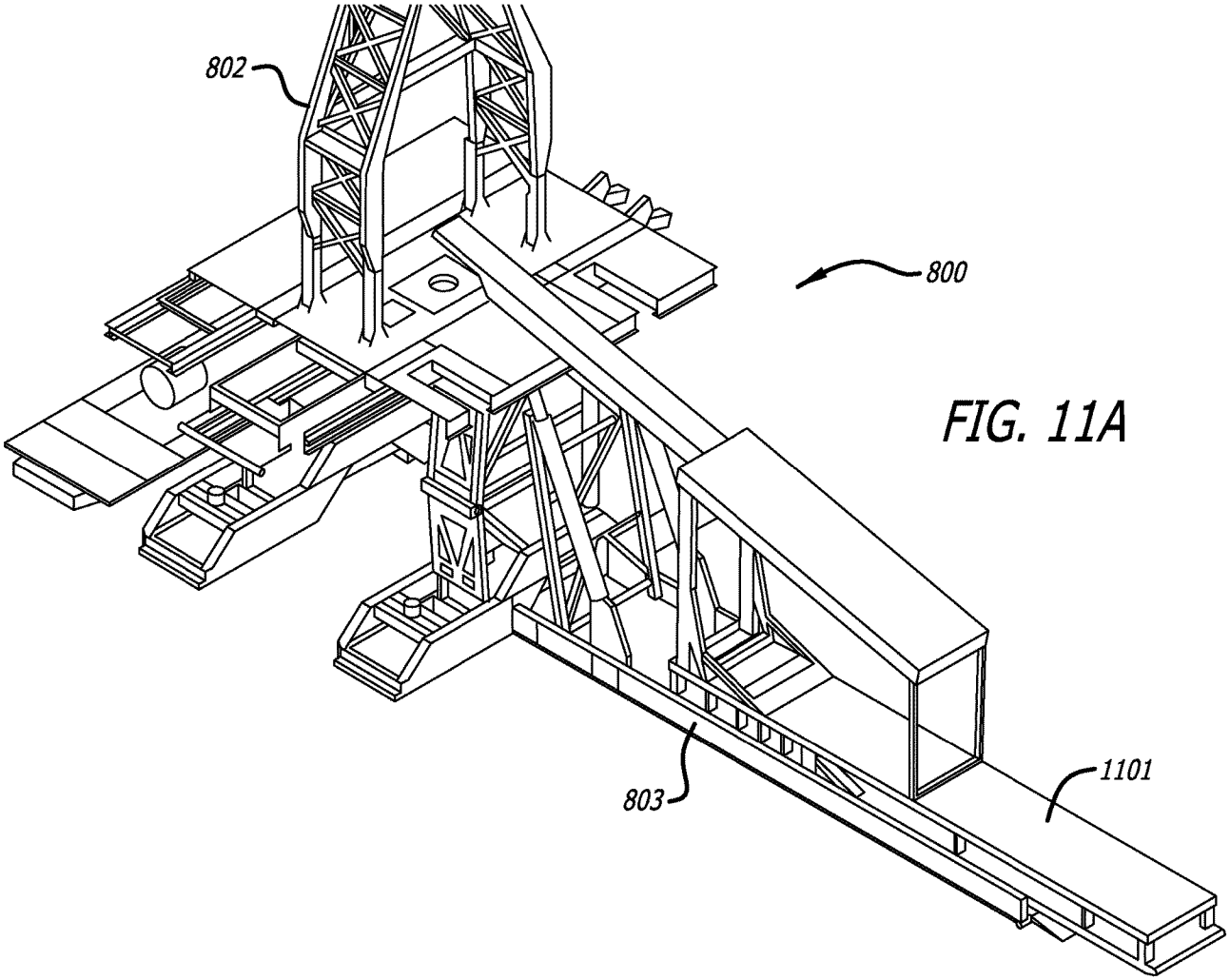
FIG. 11A illustrates the mast and substructure illustrated in FIG. 10 having a hydraulic catwalk set on top of the mud boat.
Figure 11B:
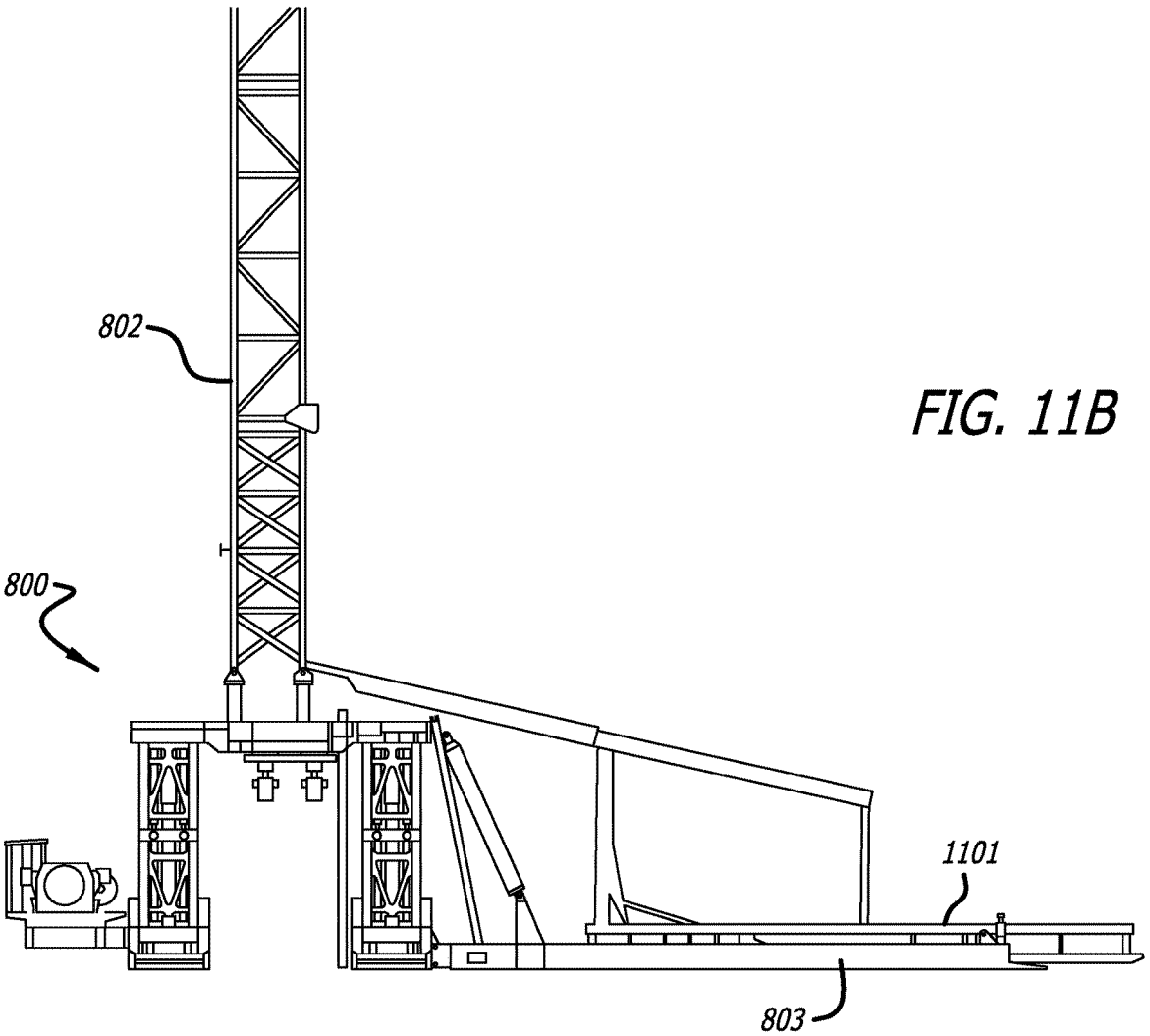
FIG. 11B illustrates a side view of the mast and substructure having a hydraulic catwalk set on top of the mud boat illustrated in FIG. 11A.

Another advantage of the present invention is that it the mud boat can be left in position after rig up of the drilling system (which further speeds up rigging up and rigging down and also eliminates the issue of what to do with the mud boat while the drilling system is in operation). FIGS. 11A-11B illustrates a perspective and side view of the mast 802 and substructure 800 illustrated in FIG. 10 having a catwalk 1101 (such as a hydraulic catwalk 1101 from Forum Energy Technologies (Houston, Tex.), National Oilwell Varco, or McCoy Global (Edmonton, Alberta)). The catwalk (hydraulic catwalk) 1101 can be set on top of the mud boat 803. When drilling multiple well pads, the catwalk (hydraulic catwalk) 1101 would be pinned to the mud boat 803 so that it can be walked with the substructure 800.

Walking the Drilling System

Walking of rigs has become more common in the industry. An additional advantage of the present invention is that its design allows for maintaining the walking system in place during transportation of the rig packages. This additional advantage provides a reduction of rig move packages and assembly/disassembly activities.

Other Advantages

In addition to the advantages outlined above, the present invention has advantages over prior art substructures including:

Sling-shot or parallelogram style substructures: The present invention can attain higher rig floor heights without extending the side box lengths and balances the raising loads reducing the package weight such that a walking systems can be integrated and left in place during transport and still be within acceptable single load transport weight resulting in fewer packages to move. The present invention also allows for easier addition of steel winterization.

Telescoping substructures: The present invention can attain higher rig floor heights without increasing the scope of work required to do so. The present invention can also be assembled/disassembled without manual intervention while telescoping columns require column clamps which historically are manually installed by personnel at a hold point during the raising process prior to the substructure being secured. As the rig floor height increases, additional stages of telescoping columns are required and additional sets of column clamps are added.

Box-in-box substructures: The present invention allows for, and has, a greater operating height to shipping height ratio. The floor height of a box-in-box substructure is limited by two times the shipping height less the required overlap. Shipping heights over 12 feet typically require routing around overpasses or specialized equipment. The floor height of a 12 feet tall shipping height box-in-box sub would be nominally 22.5 feet which may be problematic for some BOP stack/rotating head configurations.

Box-on-box substructures: The present invention has fewer packages on rig moves. To obtain a 25 foot floor in a box-on-box substructure, a least three packages per side box would be required (to stack up).

For example, assuming a 12 foot overall package shipping height to transport easily (again to keep the substructure in its transport position from being too tall to fit below standard height overpasses), a box-on-box substructure would require three packages per side box to attain a 25 foot floor operating height. Three packages per side adds additional packages and time required to stack up/disassemble the substructure.

Safety factors of the present invention further include that, if screw jacks are used, the sub is locked in place without having to set additional pins and the substructure is stable in the event of a primary lifting mechanism failure.

The examples provided herein are to more fully illustrate some of the embodiments of the present invention. It should be appreciated by those of skill in the art that the techniques disclosed in the examples which follow represent techniques discovered by the Applicant to function well in the practice of the invention, and thus can be considered to constitute exemplary modes for its practice. However, those of skill in the art should, in light of the present disclosure, appreciate that many changes can be made in the specific embodiments that are disclosed and still obtain a like or similar result without departing from the spirit and scope of the invention While embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. Accordingly, other embodiments are within the scope of the following claims. The scope of protection is not limited by the description set out above.

The disclosures of all patents, patent applications, and publications cited herein are hereby incorporated herein by reference in their entirety, to the extent that they provide exemplary, procedural, or other details supplementary to those set forth herein.

What is claimed is:

1. A system for land-based drilling operations comprising a substructure operable for moving between a transport position and an operating position, wherein the substructure comprises:

(a) a first side box comprising
- (i) a first side box upper portion having a top end,
- (ii) a first side box lower portion, and
- (iii) a first side box scissor jack support and bracing system connected to the first side box upper portion and the first side box lower portion, wherein
  - (A) the first side box scissor jack support and bracing system comprises (I) a first left upper support arm, (II) a first left lower support arm, (III) a first right upper support arm, (IV) a first right lower support arm, and (V) a first tension link, each of which having a first end and a second end,
  - (B) the first end of the first left upper support arm is pivotably connected to the first side box upper portion,
  - (C) the first end of the first left lower support arm is pivotably connected to the first side box lower portion,
  - (D) the second end of the first left upper support arm is pivotably connected to the second end of the first left lower support arm and the first end of the first tension link,
  - (E) the first end of the first right upper support arm is pivotably connected to the first side box upper portion,
  - (F) the first end of the first right lower support arm is pivotably connected to the first side box lower portion,
  - (G) the second end of the first right upper support arm is pivotably connected to the second end of the first right lower support arm and the second end of the first tension link,
  - (H) the first side box scissor jack support and bracing system is operable to move in a grand plie style movement;

(b) a second side box comprising
- (i) a second side box upper portion having a top end,
- (ii) a second side box lower portion, and
- (iii) a second side box scissor jack support and bracing system connected to the second side box upper portion and the second first side box lower portion, wherein
  - (A) the second side box scissor jack support and bracing system comprises (I) a second left upper support arm, (II) a second left lower support arm, (III) a second right upper support arm, (IV) a second right lower support arm, and a second tension link, each of which having a first end and a second end,
  - (B) the first end of the second left upper support arm is pivotably connected to the second side box upper portion,
  - (C) the first end of the second left lower support arm is pivotably connected to the second side box lower portion,
  - (D) the second end of the second left upper support arm is pivotably connected to the second end of the second left lower support arm and the first end of the second tension link,
  - (E) the first end of the second right upper support arm is pivotably connected to the second side box upper portion,
  - (F) the first end of the second right lower support arm is pivotably connected to the second side box lower portion,
  - (G) the second end of the second right upper support arm is pivotably connected to the second end of the second right lower support arm and the second end of the second tension link,
  - (H) the second side box scissor jack support and bracing system is operable to move in a grand plie style movement;

(c) a center section connecting the first side box upper portion and the second side box upper portion, wherein the center section has a top end; and (d) a floor positioned at or near the top ends of the first side box, the second side box, and the center section, wherein (i) the floor is in a substantially level position, (ii) the first side box upper portion and the first side box lower portion are operable to move straight up and down relative to each as the substructure moves between the transport position and the operating position, (iii) the second side box upper portion and the second side box lower portion are operable to move straight up and down relative to each as the substructure moves between the transport position and the operating position, and (iv) the first side box scissor jack support and bracing system and the second side box scissor jack support and bracing system are operable to maintain the floor in the substantially level position as the substructure moves between the transport position and the operating position.

2. The system for land-based drilling operations of claim 1 further comprising:

(a) at least one first linking pin that is operable for locking the first side box scissor jack support and bracing system in position such that the first side box upper portion and the first side box lower portion are not operable to move up and down relative to each when the at least one first linking pin is inserted in the first side box scissor jack support and bracing system;

(b) at least one second linking pin that is operable for locking the second side box scissor jack support and bracing system in position such that the second side box upper portion and the second side box lower portion are not operable to move up and down relative to each when the at least one second linking pin is inserted in the second side box scissor jack support and bracing system.

3. The system for land-based drilling operations of claim 1, wherein (a) the first side box scissor jack support and bracing system further comprises (i) a first left upper support brace, (ii) a first left lower support brace, (iii) a first right upper support brace, and (iv) a first right lower support brace; and (b) the second side box scissor jack support and bracing system comprises (i) a second left upper support brace, (ii) a second left lower support brace, (iii) second right upper support brace, and (iv) second right lower support brace.

4. The system for land-based drilling operations of claim 1 further comprising a hydraulic system operable for moving the substructure between the transport position and the operating position.

5. The system for land-based drilling operations of claim 4, wherein (i) the first tension link is a first telescoping tension link, (ii) the second tension link is a second telescoping tension link, and (iii) the hydraulic system comprises the first telescoping tension link, the second telescoping tension link, and a plurality of cylinders operable to lift and lower (a) the first side box upper portion relative to the first side box lower portion and (b) the second side box upper portion relative to the second side box lower portion.

6. The system for land-based drilling operations of claim 1 further comprising a screw jack system operable for moving the substructure between the transport position and the operating position.

7. The system for land-based drilling operations of claim 1, wherein (a) the substructure has a transport height of at most 10½ feet when the substructure is in the transport position; and (b) the substructure has a floor height of at least 22 feet when the substructure is in the operating position.

8. The system for land-based drilling operations of claim 1 further comprising a walking system operable for moving the system for land-based operations while the substructure is in the operating position.

9. The system for land-based drilling operations of claim 8, wherein the walking system comprises a plurality of hydraulic lift cylinders.

10. The system for land-based drilling operations of claim 1 further comprising a mast set at or near the floor of the substructure.

11. The system for land-based drilling operations of claim 10 further comprising a walking system operable for moving the system for land-based operations while the substructure is in the operating position while the mast is set at or near the floor of the substructure.

12. The system for land-based drilling operations of claim 1 further comprising a mud boat position on a side of the substructure.

13. The system for land-based drilling operations of claim 12 further comprising a catwalk positioned on the mud boat.

14. A method comprising:

(a) setting a system for land-based drilling operations at a first location at which drilling operations are to occur, wherein the system for land-based drilling operations comprises a substructure, wherein the substructure comprises (i) a first side box comprising (A) a first side box upper portion having a top end, (B) a first side box lower portion, and (C) a first side box scissor jack support and bracing system connected to the first side box upper portion and the first side box lower portion, wherein (I) the first side box scissor jack support and bracing system comprises (1) a first left upper support arm, (2) a first left lower support arm, (3) a first right upper support arm, (4) a first right lower support arm, and (5) a first tension link, each of which having a first end and a second end, (II) the first end of the first left upper support arm is pivotably connected to the first side box upper portion, (III) the first end of the first left lower support arm is pivotably connected to the first side box lower portion, (IV) the second end of the first left upper support arm is pivotably connected to the second end of the first left lower support arm and the first end of first tension link, (V) the first end of the first right upper support arm is pivotably connected to the first side box upper portion, (VI) the first end of the first right lower support arm is pivotably connected to the first side box lower portion, (VII) the second end of the first right upper support arm is pivotably connected to the second end of the first right lower support arm and the second end of the first tension link, (VIII) the first side box scissor jack support and bracing system is operable to move in a grand plie style movement;

(ii) a second side box comprising (A) a second side box upper portion having a top end, (B) a second side box lower portion, and (C) a second side box scissor jack support and bracing system connected to the second side box upper portion and the second first side box lower portion, wherein (I) the second side box scissor jack support and bracing system comprises (1) a second left upper support arm, (2) a second left lower support arm, (3) a second right upper support arm, (4) a second right lower support arm, and (5) a second tension link, each of which having a first end and a second end, (II) the first end of the second left upper support arm is pivotably connected to the second side box upper portion, (III) the first end of the second left lower support arm is pivotably connected to the second side box lower portion, (IV) the second end of the second left upper support arm is pivotably connected to the second end of the second left lower support arm and the first end of the second tension link, (V) the first end of the second right upper support arm is pivotably connected to the second side box upper portion, (VI) the first end of the second right lower support arm is pivotably connected to the second side box lower portion, (VII) the second end of the second right upper support arm is pivotably connected to the second end of the second right lower support arm and the second end of the second tension link, (VIII) the second side box scissor jack support and bracing system is operable to move in a grand plie style movement;

(iii) a center section connecting the first side box upper portion and the second side box upper portion, wherein the center section has a top end; and (iv) a floor positioned at or near the top ends of the first side box, the second side box, and the center section, wherein (A) the floor is in a substantially level position, and (B) the substructure is in a first position;

(b) moving the substructure from the first position to a second position while maintaining the floor in the substantially level position, wherein (i) the first side box upper portion is raised straight up relative to the first side box lower portion, and (ii) the second side box upper portion is raised straight up relative to the second side box lower portion; and (c) locking the substructure in the second position.

15. The method of claim 14 further comprising setting a mast at or near the floor.

16. The method of claim 15 further comprising assembling the mast apart from the substructure at the same time the substructure is being moved from the first position to the second position.

17. The method of claim 14 further comprising performing the drilling operations at the first location using the system for land-based drilling operations.

18. The method of claim 14 further comprising moving the system for land-based drilling operations from the first location to a second location at which second drilling operations are to occur, wherein the substructure remains in the second position during the step of moving.

19. The method of claim 14 further comprising moving the system to the first location while the substructure is in the first position, wherein (a) the substructure has a transport height of at most 10½ feet when the substructure is in the first position; and (b) the substructure has a floor height of at least 22 feet when the substructure is in the second position.

20. The method of claim 14, wherein the step of moving the substructure from the first position to the second position comprises using a hydraulic system.

21. The method of claim 20, wherein (a) the first tension link is a first telescoping link;

(b) the second tension link is a second telescoping link;

(c) the hydraulic system comprises a plurality of hydraulic cylinders, the first telescoping link, and the second telescoping tension link;

(b) the step of using the hydraulic system comprises extending the hydraulic cylinders to raise (i) the first side box upper portion relative to the first side box lower portion and (ii) the second side box upper portion relative to the second side box lower portion, while keeping the floor substantially level until the second position is attained; and (c) the method comprises retracting the hydraulic cylinders after the step of locking the substructure in the second position.

22. The method of claim 21, wherein the step of locking the substructure in the second position comprises installing a plurality of linking pins that lock in place the first telescoping tension link, the second telescoping tension link, the first side box scissor jack support and bracing system, and the second side box scissor jack support and bracing system.

23. The method of claim 14, wherein the step of moving the substructure from the first position to the second position comprises using a screw jack system.

24. The method of claim 23, wherein (a) the screw jack system comprises at least one screw jack; and (b) the step of using the screw jack system comprises rotating the at least one screw jack to cause (i) the first left upper support arm, the first left lower support arm, the first right upper support arm, the first right lower support arm, and first support bracing in the first side box scissor jack support and bracing system to raise the first side box upper portion relative to the first side box lower portion and (ii) the second left upper support arm, the second left lower support arm, the second right upper support arm, the second right lower support arm, and second support bracing in the second side box scissor jack support and bracing system to raise the second side box upper portion relative to the second side box lower portion, while keeping the floor substantially level until the second position is attained.

25. The method of claim 24 further comprising using a boost cylinder to assist in raising the floor of the substructure while rotating the at least one screw jack.

26. The method of claim 14 further comprising:

(a) unlocking the substructure in the second position;

(b) moving the substructure from the second position to the first position; and (c) transporting the system for land-based drilling operations to a different location while the substructure is in the first position.

27. The method of claim 26 further comprising:

(a) detaching and lowering the mast to the ground before the step of moving the substructure from the second position to the first position; and (b) disassembling the mast at the same time the substructure is being moved from the second position to the first position.

28. The method of claim 14 further comprising:

(a) for the step of setting the system for land-based drilling operations at the first location at which drilling operations are to occur, the system for land-based drilling operations comprises (i) the substructure is in a transport position that is the first position, and (ii) the floor is an operating floor located at or near the top of the substructure;

(b) moving the substructure from the transport position to an operating position that is the second position;

(c) raising a mast to the operating floor using a mast elevator;

(d) setting the mast at or near the operating floor; and (e) raising the mast to an operating configuration of the mast.

29. The method of claim 28, wherein the step of raising the mast to the operating floor using a mast elevator comprises using one or more mast raising cylinders in conjunction with a ramp.

30. The method of claim 28, wherein the step of raising the mast to the operating floor using a mast elevator comprises using one or more mast raising cylinders in conjunction with a mast elevator link.

31. The method of claim 28, wherein the step of raising the mast to the operating configuration of the mast comprises using the mast elevator.

32. The method of claim 28, wherein the step of setting the mast at or near the operating floor occurs when the substructure is in the operating position.

33. The method of claim 28, wherein the step of setting the mast at or near the floor occurs when the substructure is in the transport position.

34. The method of claim 28 further comprising locking the substructure in the operating position.

35. The system for land-based drilling operations of claim 3, wherein (a) each of the first left upper support brace, the first left lower support brace, the first right upper support brace, and the first right lower support brace of the first side box scissor jack support and bracing system has a first end and a second end, wherein (i) the first end of the first left upper support brace is pivotably connected to the first side box upper portion at a position other than where the first left upper support arm is pivotably connected to the first side box upper portion, (ii) the first end of the first left lower support brace is pivotably connected to the first side box lower portion at a position other than where the first end of the first left lower support arm is pivotably connected to the first side box lower portion, (iii) the second end of the first left upper support brace is pivotably connected to the second end of the first left lower support brace and the first end of the first tension link, (iv) the first end of the first right upper support brace is pivotably connected to the first side box upper portion at a position other than where the first end of the first right upper support arm is pivotably connected to the first side box upper portion, (v) the first end of the first right lower support brace is pivotably connected to the first side box lower portion at a position other than where the first end of the first right lower support arm is pivotably connected to the first side box lower portion, and (vi) the second end of the first right upper support brace is pivotably connected to the second end of the first right lower support brace and the second end of the first tension link; and (b) each of the second left upper support brace, the second left lower support brace, the second right upper support brace, and the second right lower support brace of the second side box scissor jack support and bracing system has a first end and a second end, wherein (i) the first end of the second left upper support brace is pivotably connected to the second side box upper portion at a position other than where the second left upper support arm is pivotably connected to the second side box upper portion, (ii) the first end of the second left lower support brace is pivotably connected to the second side box lower portion at a position other than where the first end of the second left lower support arm is pivotably connected to the second side box lower portion, (iii) the second end of the second left upper support brace is pivotably connected to the second end of the second left lower support brace and the first end of the second tension link, (iv) the first end of the second right upper support brace is pivotably connected to the second side box upper portion at a position other than where the first end of the second right upper support arm is pivotably connected to the second side box upper portion, (v) the first end of the second right lower support brace is pivotably connected to the second side box lower portion at a position other than where the first end of the second right lower support arm is pivotably connected to the second side box lower portion, and (vi) the second end of the second right upper support brace is pivotably connected to the second end of the second right lower support brace and the second end of the second tension link.

* * * * *